US005866311A

United States Patent [19]

Droin et al.

[11] Patent Number: 5,866,311

[45] Date of Patent: Feb. 2, 1999

[54] COLOR REVERSIBLE PHOTOGRAPHIC PRODUCT

[75] Inventors: Gerard M. Droin, Beaune; Yannick Begel, Chalon Sur Saone, both of France

[73] Assignee: Eastman Kodak Company, Rochester, N.Y.

[21] Appl. No.: 929,325

[22] Filed: Sep. 12, 1997

[30] Foreign Application Priority Data

Oct. 18, 1996 [FR] France ..... 96 12937

[51] Int. Cl.[6] ..... G03C 1/46

[52] U.S. Cl. ..... 430/505; 430/504; 430/549

[58] Field of Search ..... 430/504, 505, 430/549

[56] References Cited

U.S. PATENT DOCUMENTS

| | | | |
|---|---|---|---|
| 4,806,460 | 2/1989 | Ogawa et al. | 430/504 |
| 4,946,765 | 8/1990 | Hahm | 430/504 |
| 5,302,500 | 4/1994 | Irie et al. | 430/505 |
| 5,770,354 | 6/1998 | Massirib et al. | 430/506 |

FOREIGN PATENT DOCUMENTS

| | | |
|---|---|---|
| 514743 | 11/1992 | European Pat. Off. . |
| 304297 | 2/1993 | European Pat. Off. . |
| 570923 | 11/1993 | European Pat. Off. . |
| 666502 | 8/1995 | European Pat. Off. . |
| 1474994 | 5/1977 | United Kingdom . |

*Primary Examiner*—John A. McPherson
*Attorney, Agent, or Firm*—Andrew J. Anderson

[57] ABSTRACT

The present invention concerns a color reversible photographic product In particular, the present invention concerns a new photographic product which has a increase in the exposure latitude of one of the silver halide emulsion layers with which a dye-forming coupler is associated without changing the chromatic balance. This increase in the exposure latitude makes it possible to improve the details of the dye image.

10 Claims, 2 Drawing Sheets

COLOR REVERSIBLE PHOTOGRAPHIC PRODUCT

FIELD OF THE INVENTION

The present invention concerns a color reversible photographic product. In particular it concerns a silver halide photographic product in which details have been improved.

BACKGROUND OF THE INVENTION

In conventional color photography, photographic products contain three superimposed units of silver halide emulsion layers, one for forming a latent image corresponding to an exposure to blue light (blue-sensitive), one for forming a latent image corresponding to an exposure to green and one for forming a latent image corresponding to an exposure to red light.

During photographic treatment, the developing agent reduces the silver ions of each latent image. The resulting oxidized developing agent, then reacts in each unit with a dye-forming coupler in order to produce images in yellow, magenta and cyan dyes respectively from the recordings in blue, green and yellow. This produces negative dye images.

The reversible photographic products which make it possible to obtain positive images comprise the same three superimposed units of silver halide emulsion layers, each of these units containing respectively a yellow, magenta and cyan dye-forming coupler. After exposure, these reversible photographic products are subjected to a first black and white development (development of the latent image), and then to a step of chemical reversal or fogging exposure, which makes it possible to make the silver halides which were not initially exposed developable. After reversal, the photographic product is treated in a color development bath in the presence of couplers, generally contained in the photographic product.

Color photographic products are evaluated on the basis of sensitometric curves indicating the colored density of each of the yellow, magenta and cyan components as a function of luminance, that is to say the intensity of exposure. In order to achieve a good chromatic balance it is very important to obtain similar characteristic curves for the three sensitive layers, that is to say of the same form and superimposed. Indeed, when these curves are not similar, this causes a dominant or poor color rendition. When the characteristic curves of each of the sensitive layers are superimposed, an exposure of the photographic product in white light must give a neutral total density value, which corresponds to a neutral gray tone.

In order to reproduce detail in the image it is also important to use photographic products with a wide exposure latitude. The exposure latitude is a measurement of the suitability of a photographic product for recording the differences in exposure intensity and for representing them through differences in density. For a given range of exposure intensities, the more there are smaller differences in image density reproduced, the more details there are in the color image.

It is known that the exposure latitude of a photographic product can be increased by modifying the silver halide photographic emulsions. For example, it is known that the size dispersity of an emulsion can be increased in order to increase the rendition of details.

It is also known that a layer of silver halide emulsions can be chromatized over more than one region of the light spectrum in order to improve the reproduction of the colors of the image. For example, patent EP 304297 describes a photographic product comprising a layer of silver halide emulsions which is chromatized in two regions of the light spectrum in order to increase the exposure latitude.

U.S. Pat. No. 4,946,765 describes a color photographic paper which comprises a first and second layer of silver halide emulsion, each of these layers being sensitized in a different region of the light spectrum and containing a particular dye-forming coupler. In order to improve the exposure latitude of the product, this patent discloses the introduction into the product, between the two layers of emulsions, of an intermediate layer which is not sensitive to light and which contains a non-diffusible colorless coupler forming during development a complementary dye with the main sensitivity of the second silver halide emulsion layer.

All these modifications of the photographic product which tend to change its exposure latitude also change the form of the sensitometric curves of each of the light-sensitive layers and consequently impair the superimposability of the curves. By increasing the exposure latitude using these techniques, the chromatic balance is changed.

SUMMARY OF THE INVENTION

The object of the present invention is to provide a novel photographic product which exhibit an increase in the exposure latitude in colored light of one of the silver halide emulsion layers, with which a dye-forming coupler is associated, without changing the chromatic balance. This increase in exposure latitude makes it possible to improve the rendition of the details of the dye image.

A particular object of the present invention is to provide a photographic product in which the rendition of details in the red areas of the image is improved. Another object of the invention is to provide a photographic product in which the rendition of details in the blue areas of the image is improved. An object of the invention is also to improve the rendition of details in the green areas of the image.

A final object of the invention is to improve the rendition of details in one or more of the sensitive layers of the photographic product The present invention concerns a color-reversible photographic product comprising a support, at least one blue-sensitive silver halide emulsion layer, with which a yellow dye-forming coupler is associated, at least one green-sensitive silver halide emulsion layer, with which a magenta dye-forming coupler is associated, and at least one red-sensitive silver halide emulsion layer, with which a cyan dye-forming coupler is associated, each coupler being present in a ratio to the quantity of silver which enables a dye image with a maximum density (Dmax) of at least 2 to be obtained, wherein a moiety of the quantity of one of the dye-forming couplers necessary for the formation of the dye image with a Dmax of at least 2 is introduced into one of the emulsion layers other than that with which the coupler is associated, the silver content of these layers being modified in order to maintain the same ratio between the quantity of couplers and the quantity of silver and in that the emulsions of each of the sensitive layers are chosen so that the photographic product has no inter-image effect.

The present invention concerns a color reversible photographic product comprising a support, at least one blue-sensitive silver halide emulsion layer, with which a yellow dye-forming coupler is associated, at least one green-sensitive silver halide emulsion layer, with which a magenta dye-forming coupler is associated, and at least one red-sensitive silver halide emulsion layer, with which a cyan dye-forming coupler is associated, each coupler being present in a ratio to the quantity of silver which enables a dye image with a maximum density (Dmax) of at least 2 to be obtained, wherein a part of the quantity of one of the dye-forming couplers necessary for the formation of the dye image with a Dmax of at least 2 is introduced into one of the emulsion layers other than that with which the coupler is associated, the silver content of these layers being modified in order to maintain the same ratio between the quantity of couplers and the quantity of silver; the silver halide composition of the photographic product corresponds to the formula $AgBr_xCl_yI_z$ in which $x+y+z=1$ and $z \leqq 0.05$, and the variation in the silver iodide content between two sensitive layers is such that $\Delta(z_n-z_m) \leqq 0.05$, $z_n$ and $z_m$ being the average silver iodide contents of each of these layers.

This distribution of dye couplers in the photographic product, associated with the conditions concerning the iodide content, makes it possible to improve the details in the colored areas of the image from low to high exposures.

According to one embodiment, the present invention concerns a color reversible photographic product in which part of the quantity of magenta dye-forming coupler necessary for the formation of a magenta image with a maximum density of at least 2 is introduced into the red-sensitive silver halide emulsion layer, with which a cyan dye-forming coupler is associated, the silver content of the green-sensitive layer, with which the magenta dye-forming coupler is associated, and of the red-sensitive layer, with which the cyan dye-forming coupler is associated, being modified in order to maintain, in each of these layers, the same ratio between the quantity of couplers and the quantity of silver.

This distribution of the magenta dye coupler in the color photographic product makes it possible to improve the details in the red areas of the image without changing the chromatic balance of the photographic product.

According to another embodiment, the present invention concerns a color-reversible photographic product in which part of the quantity of magenta dye-forming coupler necessary for the formation of a magenta image with a maximum density of at least 2 is introduced into the blue-sensitive silver halide emulsion layer, with which a yellow dye-forming coupler is associated, the silver content of the green-sensitive layer, with which the magenta dye-forming coupler is associated, and of the blue-sensitive layer, with which the yellow dye-forming coupler is associated, being modified in order to maintain, in each of these layers, the same ratio between the quantity of couplers and the quantity of silver.

This distribution of the magenta dye coupler in the color photographic product makes it possible to improve the details in the blue areas of the image without changing the chromatic balance of the photographic product.

According to another embodiment, the present invention concerns a color reversible photographic product in which part of the quantity of cyan dye-forming coupler necessary for the formation of a cyan image with a maximum density of at least 2 is introduced into the green-sensitive silver halide emulsion layer, with which a magenta dye-forming coupler is associated, the silver content of the green- sensitive layer, with which the magenta dye-forming coupler is associated, and of the red-sensitive layer, with which the cyan dye-forming coupler is associated, being modified in order to maintain in each of these layers the same ratio between the quantity of couplers and the quantity of silver.

This distribution of the cyan dye coupler in the color photographic product makes it possible to improve the details in the green areas of the image without changing the chromatic balance of the photographic product.

Figure 1:
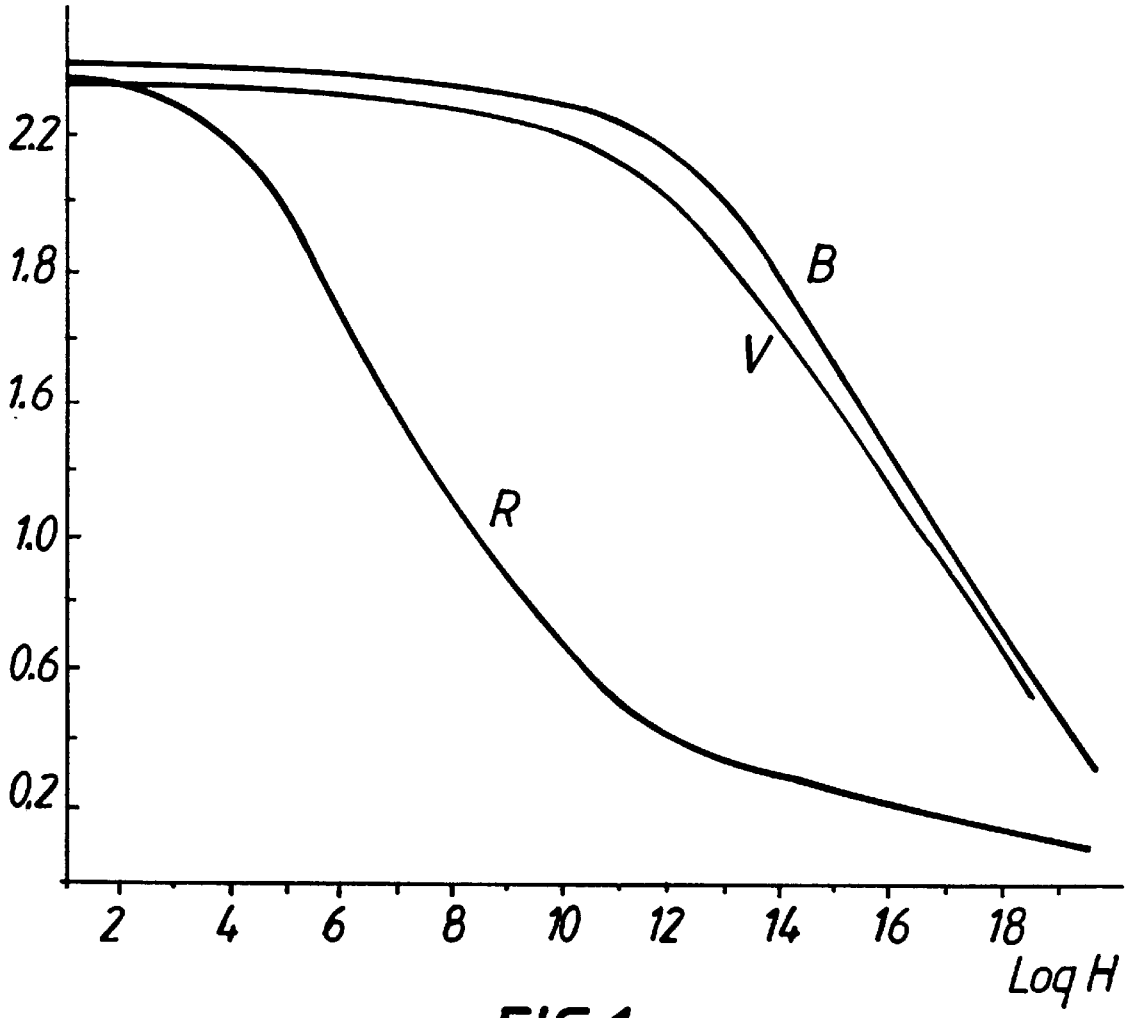
FIG. 1 is a sensitometric curve of a control color reversible photographic product exposed in red light.

For a better understanding of the present invention, together with other and further objects, advantages and capabilities thereof, reference is made to the following detailed description and appended claims in connection with the preceding drawings and description of some aspects of the invention.

DETAILED DESCRIPTION OF THE PREFERRED EMBODIMENTS

The maximum quantity of dye-forming couplers which is redistributed in the photographic product according to the present invention is that which, in each case, represents a compromise between the increase in the exposure latitude and an acceptable rendition of the colors. For example, where a too large part of the magenta coupler normally present in the green-sensitive silver halide emulsion layer is introduced into the red-sensitive layer, the rendition of the green color in the photographic product will not be obtained in a satisfactorily.

According to a particular embodiment, the quantity of couplers which is introduced into a layer other than that with which the coupler is normally associated is between 1 and 25%, preferably between 3 and 20%, based on the total quantity of coupler necessary for obtaining a dye image with a maximum density of at least 2.

In the scope of the invention, densities are measured by an X-Rite densitometer equipped with a Status A.

In addition, in order not to modify the speed of the reaction between the oxidized developing agent and the coupler or couplers, it is necessary, in the context of the present invention, to modify the silver content of the silver halide photographic layers in accordance with the distribution of the dye-forming coupler in these layers.

According to the scope of the present invention, the dye-forming couplers are conventional dye-forming couplers with 2 or 4 equivalents. These couplers are compounds which react with the color developing agent in its oxidized form in order to form a cyan, magenta or yellow image dye. These couplers are generally colorless and non-diffusible.

The cyan dye-forming couplers which can be useful in the scope of the present invention are described in Research Disclosure, September 1994, Number 36544, Part X (referred to in the remainder of the description as Research Disclosure). Such couplers have been described in U.S. Pat. Nos. 2,367,531; 2,423,730; 2,474,293; 2,772,162; 2,895,826; 3,002,836; 3,034,892; 3,041,236; 4,333,999; and 4,883,746. Preferably, these couplers are phenols or naphthols.

The magenta dye-forming couplers which can be useful in the scope of the present invention are described in Research Disclosure, Part X. Such couplers have been described in U.S. Pat. Nos. 2,311,082; 2,343,703; 2,369,489; 2,600,788; 2,908,573; 3,062,653; 3,152,896; and 3,519,429. Preferably, these couplers are pyrazolones, pyrazolotriazoles or pyrazolobenzimidazoles.

The yellow dye-forming couplers which can be useful in the scope of the invention are described in Research Disclosure, Part X. Such couplers have been described in U.S. Pat. Nos. 2,298,443; 2,407,210; 2,875,057; 3,048,194; 3,265,506; 3,447,928; 4,022,620; and 4,443,536. Conventionally, these couplers are open-chain ketomethylene compounds.

In the context of the present invention, the total quantity of a dye-forming coupler is the quantity necessary for the formation of an image of this dye having a maximum density at least equal to 2. This quantity depends on the type of dye-forming coupler used, the silver content, the type of emulsion etc.

The photographic product of the present invention comprises a support having thereon at least one of its faces, at least 3 silver halide emulsion layers sensitive to radiation.

As described above, the iodide content of the photographic product plays an important role in the present invention. This is because the photographic products of the present invention are products which have no or little inter-image effect. The inter-image effects of a photographic product appear, inter alia, when there are major variations in the type or composition of silver halide in the different layers of the photographic product, for example inter-image effects are observed when the variation in iodide content from one sensitive layer to the other varies by more than 30. It is known that the inter-image effect improves the rendition of colors, but limits the developability of the product owing to the major variation in halides from one layer to another.

Provided that they meet the criteria defined above, the silver halide emulsions of the product of the invention can be chloride, bromide, chlorobromide, bromochloride, chloroiodide, bromoiodide or bromochloroiodide emulsions.

According to a particular embodiment, the silver halide composition of the photographic product corresponds to the formula $AgBr_xCl_yI_z$ in which $x+y+z=1$ and $0.03 \leqq z \leqq 0.05$.

As described above, it is preferable for the distribution of silver iodide in the photographic product to be homogeneous, that is to say that the variation in the silver iodide content between two layers is such that $\Delta(z_n-z_m) \leqq 0.05$. According to a particular embodiment, the variation in the silver iodide content between two layers is such that $\Delta(z_n-z_m) \leqq 0.03$.

According to a particular embodiment, each emulsion forming part of the photographic product of the invention is an emulsion containing silver iodide. According to a preferred embodiment, the silver iodide content of each of these emulsions does not exceed 5% mol, in relation to the total quantity of silver halides contained in the emulsion.

In the context of the invention, the distribution of the halides in the grain can be uniform or variable. The grains can have a core-shell structure. The silver halide grains can be doped by the introduction of osmium, iridium, rhodium, rutheniun etc.

The silver halide grains can be of different morphologies (see section 1-B of Research Disclosure). These grains can be three-dimensional grains, that is to say octahedral, cubic etc, or tabular.

The silver halide grains can be chemically sensitized as described in Research Disclosure, Section IV. Conventionally, the emulsions are sensitized with sulfur, selenium, gold etc. It is also possible to chemically sensitize the emulsions by reduction, that is to say by the introduction of a reducing agent.

The silver halide emulsions consist of silver halide grains in a hydrophilic binder, for example gelatin. The different methods of preparing these emulsions are described in Research Disclosure, Section I-C. The gelatin can be replaced in part by other synthetic or natural hydrophilic colloids such as albumin, casein, zein, a polyvinyl alcohol, the derivatives of cellulose such as for example carboxymethylcellulose. Such colloids are described in Section II of Research Disclosure.

The silver halide grains can be sensitized spectrally as described in Research Disclosure, Section V. The conventional sensitizing dyes are polymethine dyes which comprise cyanines, merocyanines, complex cyanines and merocyanine, oxonols, hemioxonols, styryls, merostyryls, streptocyanines, hemicyanines and arylidenes.

In addition to the aforementioned compounds, the photographic product can contain other photographically useful compounds, for example coating aids, stabilizers, plasticizers, anti-fog agents, tanning agents, antistatic agents, matting agents etc. Examples of these compounds are described in Research Disclosure, Sections VI, VII, VIII, X.

The supports which can be used in photography are described in Section XV of Research Disclosure. These supports are generally polymer supports such as cellulose, polystyrene, polyamide or polyvinyl polymers, polyethylene, polyester, paper or metallic supports.

The photographic products can contain other layers, for example a protective top layer, intermediate layers, an antihalation layer, an antistatic layer, anti-UV layers etc. These different layers and their arrangements are described in Section XI of Research Disclosure.

The following examples illustrate the present invention in more detail.

EXAMPLES

EXAMPLE 1

A color photographic product was prepared having the following structure (content in $g/m^2$):

Layer 1 Protective top layer containing a 50/50 mol bromochloride emulsion with fine non-light-sensitive grains (0.025)

Layer 2 Anti-UV layer containing gelatin (1) and an ultraviolet-absorbing compound (5.6)

Layer 3 Blue-sensitive layer comprising: an AgBrI (3.4% I mol) polydisperse emulsion (85% by weight), ECD=1 μm, and a AgBrI (3.7% I mol.) Core/Shell emulsion (15% by weight) with octahedral grains, ECD=0.73 μm Yellow dye-forming coupler (0.8) (COUP-1)

Blue-sensitizing spectral dye (C-1)

Silver content (0.4)

Gelatin content (1.4)

Layer 4 Filter layer comprising yellow colloidal silver (0.15) and gelatin (0.8)

Layer 5 Green-sensitive layer comprising: a tabular grain emulsion (30% by weight) (ECD=1.3 μm, thickness 0.13 μm) AgBrI (4.1% I mol.), an AgBrI (3.4% I mol.) polydisperse emulsion (35% by weight), ECD=1 μm, an AgBrI (3.7% I mol.) Core/Shell emulsion with octahedral grains (17% by weight), ECD=0.8 μm, an AgBrI (3.7% I mol.) Core/Shell emulsion with octahedral grains (18% by weight), ECD=0.5 μm magenta dye-forming coupler (0.4) (COUP-2)

Green-sensitizing spectral dye (C-2)

Silver content (0.23)

Gelatin content (0.7)

Layer 6 Layer containing gray colloidal silver (0.05) and gelatin (1.1)

Layer 7 Red-sensitive layer comprising: an AgBrI (3.7% I mol) core/shell emulsion with octahedral grains (60% by weight), ECD=1.15 μm, an AgBrI (3.7% I mol) Core/Shell emulsion with octahedral grains (19% by weight), ECD=0.6 μm, an AgBrI (3.7% I mol) core/shell emulsion with octahedral grains (21% by weight), ECD 0.5 μm Cyan dye-forming coupler (0.45)

(COUP 3)

Red-sensitizing spectral dye (C-3)

Silver content (0.3)

Gelatin content (0.95)

Layer 8 Gelatin+permanent cyan dye (0.03)

Support Paper support covered with a layer of polyethylene

Core/Shell emulsions are emulsions with monodisperse octahedral grains (COV≦35%), whose shell consists of silver bromide and whose core consists of silver bromoiodide. The monodispersity of the emulsion is calculated on the basis of the coefficient of variation (COV) which, expressed as a percentage, is equal to (σ/D)*100 in which σ is the standard deviation of the grain population and D is the average grain size, represented either by the average diameter when the silver halide grains are circular or by the average value of the equivalent circular diameters corresponding to the projected surface of the image of the grains (ECD) when the grains are not circular. Blue-sensitizing spectral dye: C-1

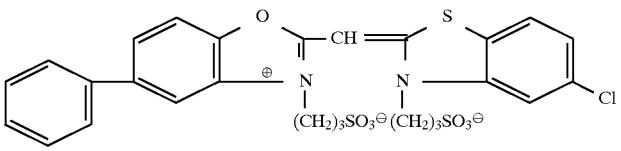

Green-sensitizing spectral dye: C-2

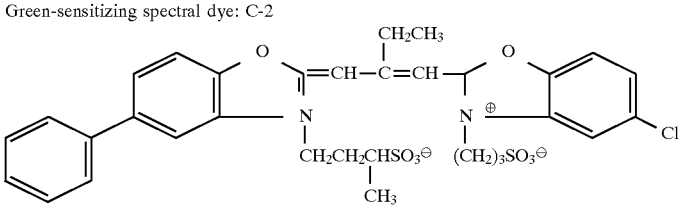

Red-sensitizing spectral dyes: C-3

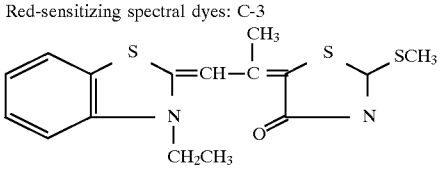

et

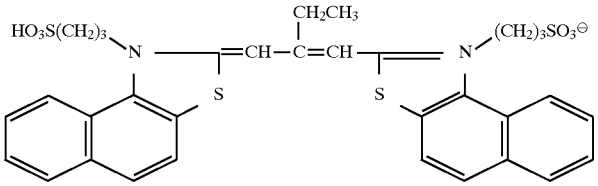

Yellow dye-forming coupler COUP-1

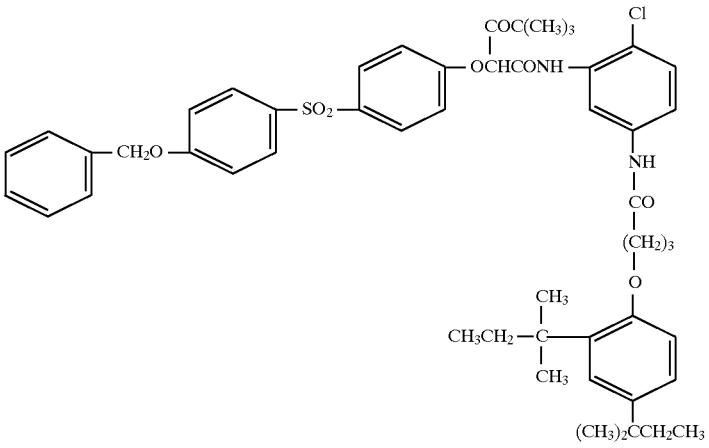

-continued

Magenta dye-forming coupler COUP-2

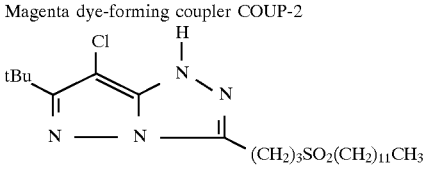

Cyan dye-forming coupler COUP-3

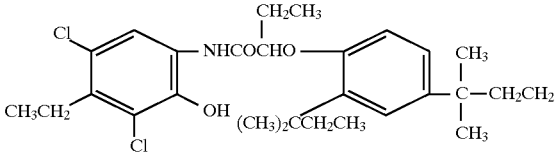

A sample of the photographic product described above was exposed with a tungsten lamp (color temperature 2850° K.) for ½ a second through a neutral sensitometric wedge.

A second sample of this product was exposed in red light according to the following method: the sample was firstly exposed in white light for 0.5 second through a red Wratten 92 filter, this exposure was followed by a second exposure for 0.5 second through a green Wratten 93 filter and a neutral sensitometric wedge, this being followed by a third exposure for 0.5 second through a blue Wratten 94 filter and a neutral sensitometric wedge.

After exposure, these samples were processed in an AUTOPAN® automatic processing machine comprising conventional KODAK® Ektachrome® R-3 processing baths.

The standard Ektachrome® R-3 processing comprises the following steps:

Black and white development 1 min 15
Washing 1 min 30
Re-exposure
Color development (38° C.) 2 min 15
Washing 0 min 45
Bleaching/fixing 2 min
Washing 2 min 15

EXAMPLE 2

A photographic product comparable to that described above was prepared, in which the quantity of magenta dye-forming coupler in layer (5) was reduced by 15% by weight and this same quantity, that is to say 15%, of magenta coupler was introduced into the cyan layer (layer 7).

In order to conserve the same ratio between the quantity of coupler and the quantity of silver contained in each of the layers, the silver contents of layers (5) and (7) were modified. The silver content of layer (5) was reduced by 15% by weight, the silver content of layer (7) was increased by 15%.

This modification of the silver content makes it possible to conserve comparable dye formation kinetics in each of the layers of Example 1.

A sample of this photographic product described above was exposed in white light.

A second sample of this product was exposed in red light as described above.

The exposed samples were developed as described in Example 1.

Results

For each sample exposed and developed, the following sensitometric characteristics are determined for each of the layers sensitive to red, green and blue.

1) The shoulder density (0.5 SD) which is represented by the density at an exposure 0.5 Log E lower than the exposure giving a density of 0.8.

2) The toe density (0.4 TD) which is represented by the density at an exposure 0.4 Log E greater than the exposure giving a density of 0.8.

3) The maximum density (Dmax) which corresponds to the density of a non-exposed area.

4) The minimum density (Dmin) which is represented by the density at an exposure 1.6 Log E greater than the exposure giving a density of 0.8.

TABLE 1

| | Exposure in white light | | |
|---|---|---|---|
| | Red | Green | Blue |
| CONTROL | | | |
| Dmin | 0.12 | 0.12 | 0.11 |
| Dmax | 2.48 | 2.32 | 2.42 |
| 0.5 SD | 1.53 | 1.39 | 1.51 |
| 0.4 TD | 0.29 | 0.40 | 0.30 |
| INVENTION | | | |
| Dmin | 0.12 | 0.12 | 0.11 |
| Dmax | 2.42 | 2.38 | 2.42 |
| 0.5 SD | 1.50 | 1.43 | 1.51 |
| 0.4 TD | 0.29 | 0.36 | 0.30 |

The sensitometric results show that the product of the invention does not present any chromatic imbalance when it is exposed in white light. The characteristics of the control product and of the product of the invention are comparable and give a neutral gray density.

FIG. 1 depicts the sensitometric curves of the control photographic product after exposure in red light according to the method described above.

Figure 2:
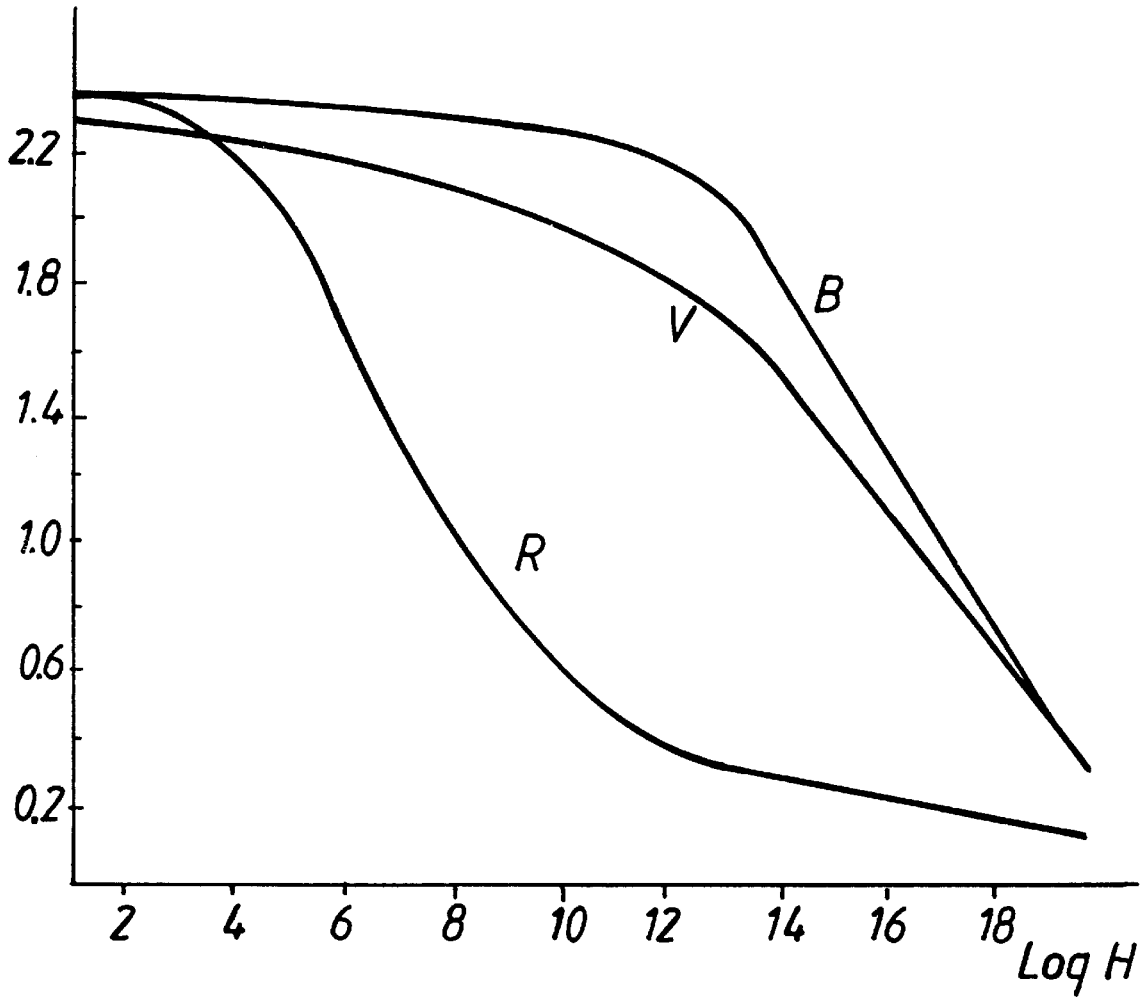
FIG. 2 is a sensitometric curve of the color reversible photographic product of the present invention exposed in red light.

FIG. 2 depicts the sensitometric curves of the photographic product of the invention, after exposure in red light according to the method described above.

The sensitometric curve giving the response in red light of the green-sensitive layer has a wider exposure latitude than the green-sensitive layer of the control photographic product. This increase in the exposure latitude of the green-sensitive layer makes it possible to improve the details of the red image when exposed in red light.

The invention has been described in detail with particular reference to certain preferred embodiments thereof, but it will be understood that variations and modifications can be effected within the spirit and scope of the invention.

We claim:

1. Color reversible photographic product comprising a support, at least one blue-sensitive silver halide emulsion layer, with which a yellow dye-forming coupler is associated, at least one green-sensitive silver halide emulsion layer, with which a magenta dye-forming coupler is associated, and at least one red-sensitive silver halide emulsion layer, with which a cyan dye-forming coupler is associated, each coupler being present in a ratio to the quantity of silver enabling a dye image with a maximum density (Dmax) of at least 2 to be obtained, wherein a part of the quantity of one of the dye-forming couplers necessary for the formation of this dye image with a Dmax of at least 2 is introduced into one of the emulsion layers other than that with which the coupler is associated, the silver content of these layers being modified in order to maintain the same ratio between the quantity of couplers and the quantity of silver and in that the emulsions of each of the sensitive layers are chosen so that the photographic product has no inter-image effect.

2. Photographic product according to claim 1, wherein the emulsions of each of the sensitive layers are chosen so that the average silver halide composition of the photographic product corresponds to the formula $AgBr_xCl_yI_z$ in which $x+y+z=1$ and $z \leqq 0.05$, and the variation in the iodide content between two sensitive layers is such that $\Delta(z_n-z_m) \leqq 0.05$, $z_n$ and $z_m$ representing the average iodide contents of each of these layers.

3. Photographic product according to claim 2, wherein the average silver halide content in the product is such that $x+y+z=1$, $0.03 \leqq z \leqq 0.05$ and $\Delta(z_n-z_m) \leqq 0.03$.

4. Photographic product according to claim 1, wherein part of the quantity of magenta dye-forming coupler necessary for the formation of a magenta image with a maximum density of at least 2 is introduced into the red-sensitive silver halide emulsion layer, with which a cyan dye-forming coupler is associated, the silver content of the green-sensitive layer, with which the magenta dye-forming coupler is associated, and of the red-sensitive layer, with which the cyan dye-forming coupler is associated, being modified in order to maintain, in each of these layers, the same ratio between the quantity of couplers and the quantity of silver.

5. Photographic product according to claim 4, wherein the part of the magenta dye-forming coupler introduced into the red-sensitive layer is between 3 and 20%.

6. Photographic product according to claim 1, wherein part of the quantity of magenta dye-forming coupler necessary for the formation of a magenta image with a maximum density of at least 2 is introduced into the blue-sensitive silver halide emulsion layer, with which a yellow dye-forming coupler is associated, the silver content of the green-sensitive layer, with which the magenta dye-forming coupler is associated, and of the blue-sensitive layer, with which the yellow dye-forming coupler is associated, being modified in order to maintain, in each of these layers, the same ratio between the quantity of couplers and the quantity of silver.

7. Photographic product according to claim 1, wherein part of the quantity of cyan dye-forming coupler necessary for the formation of a cyan image with a maximum density of at least 2 is introduced into the green-sensitive silver halide emulsion layer, with which a magenta dye-forming coupler is associated, the silver content of the green-sensitive layer, with which the magenta dye-forming coupler is associated, and of the red-sensitive layer, with which the cyan dye-forming coupler is associated, being modified in order to maintain, in each of these layers, the same ratio between the quantity of couplers and the quantity of silver.

8. Photographic product according to claim 1, wherein the part of the dye-forming coupler introduced into one of the layers other than that with which the coupler is associated is between 1 and 25% of the quantity of this coupler necessary for obtaining a dye image having a maximum density of at least 2.

9. Photographic product according to claim 1, wherein the support is a reflective support.

10. Photographic product according to claim 1, wherein the support is transparent.

* * * * *